United States Patent [19]

Fein et al.

[11] 4,260,499

[45] Apr. 7, 1981

[54] WATER-BASED LUBRICANTS

[75] Inventors: Richard S. Fein, Poughkeepsie; Charles T. Powers, Beacon, both of N.Y.

[73] Assignee: Texaco Inc., White Plains, N.Y.

[21] Appl. No.: 937,024

[22] Filed: Aug. 25, 1978

[51] Int. Cl.[3] ..... C10M 3/40; C10M 3/18; C10M 3/04

[52] U.S. Cl. ..... 252/32.5

[58] Field of Search ..... 252/32.5, 49.3, 49.8, 252/75, 33, 40.7; 72/42

[56] References Cited

U.S. PATENT DOCUMENTS

| | | | |
|---|---|---|---|
| 2,825,693 | 3/1958 | Beanbien et al. | 252/32.5 |
| 3,277,001 | 10/1966 | Fischer et al. | 252/32.5 |
| 3,793,199 | 2/1974 | Schlicht | 252/32.5 |

*Primary Examiner*—Delbert E. Gantz
*Assistant Examiner*—Irving Vaughn
*Attorney, Agent, or Firm*—Carl G. Ries; Robert A. Kulason; Henry W. Archer

[57] ABSTRACT

Water-based lubricants having anti-wear and extreme pressure properties containing from 0.1 to 5 percent by weight of an additive package consisting essentially of 0.005 to 4.0 percent of an alkyl phosphonate or an amine adduct thereof; 0.003 to 0.60 percent of an alkaline earth metal hydroxide and or a dye, an ethoxylate of an acid or an alcohol; the balance water.

4 Claims, No Drawings

WATER-BASED LUBRICANTS

BACKGROUND OF THE INVENTION

Field of the Invention

This invention relates to a water base lubricant having anti-wear and extreme pressure properties comparable with those of currently used hydraulic mineral oils.

Heretofore, emulsion type hydraulic fluids and other water based lubricating fluids have been found deficient in extreme pressure and anti-wear properties particularly in regards pump wear. However, from the standpoints of economics and fire resistance, water-based lubricants remain attractive.

SUMMARY OF THE INVENTION

The lubricant compositions of the invention comprise 0.005 to 4.0 in weight percent of a $C_6$–$C_{18}$ alkylphosphonate or adduct thereof; 0.005 to 4.0 percent of an acid or an alcohol ethoxylate; 0.003 to 0.60% of an alkali earth metal hydroxide and/or of a dye, and 95 to 99½ percent water.

Suitable alkylphosphonates are disclosed and claimed in coassigned U.S. Pat. No. 3,793,199 such as ammonium salts of alkyl alkanephosphonates represented by the formula:

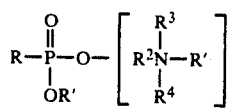

in which R is a substantially straight chain aliphatic radical having from about 11 to 40 carbon atoms, R′ is a lower aliphatic radical having from one to eight carbon atoms, $R^2$ is a hydrocarbyl radical having from 1 to 40 carbon atoms and $R^3$ and $R^4$ are hydrogen, a hydrocarbyl radical having from one to 40 carbon atoms, or a substituted hydrocarbyl radical having amino, alkylamino or hydroxyl functional groups.

Ethoxylates suitable for the invention include: ethoxylated oleic acid, ethoxylated dimer acid, ethoxylated rosin fatty acids and the like.

Dyes suitable for the present invention include: methyl orange, thymol blue, p-naphthyl benzene and the like.

Table I–IV below compare Four Ball Test results obtained with various formulations of the invention. The Load Wear Index (LWI) given in Table I and III indicates the load carrying property of a lubricating fluid. It is an overall index of the ability of a lubricant to prevent wear and welding at applied loads. Under the conditions of the test, specific loadings in Kilograms having intervals of 0.1 logarithmic units are applied to three stationary balls for ten runs. The actual test procedure is described in detail in ASTM D2783-71. In Tables I and III the antiwear action at each of the test loads is given by the AntiWear Number (AWN). AWN was determined as set forth in *Lubrication Engineering* (Vol. 51, 881–2, 1975). The Four Ball Weat Test which determines wear preventive characteristics in sliding steel-on-steel applications was carried out as described in ASTM D 2266-67, modified as set forth in Tables II and IV. These wear results are also given in terms of Anti-Wear Number to allow direct comparison of data from different loads, test durations and machines.

TABLE I

FOUR BALL LOAD WEAR INDEX TEST RESULTS WITH HYDROXIDE

| LUBRICANT | | AWN Load, Kg | | | | | |
|---|---|---|---|---|---|---|---|
| 1% A[1] in $H_2O$ | LWI | 79 | 100 | 126 | 158 | 200 | 250 |
| No $Ca(OH)_2$ | 49 | 6.5 | 6.2 | 6.3 | Weld | | |
| +.00375% $Ca(OH)_2$ | 62 | 6.5 | 6.35 | 6.3 | 6.4 | Weld | |
| +.0075% $Ca(OH)_2$ | 49 | 7.3 | 6.1 | 6.05 | Weld | | |
| +.015% $Ca(OH)_2$ | 49 | 6.5 | 6.1 | 6.05 | Weld | | |
| +.030% $Ca(OH)_2$ | 39 | 6.2 | 6.2 | Weld | — | — | |
| | 62;62 | 6.5;6.5 | 6.2;6.3 | 6.3;6.7 | 6.0;6.4 | Weld;Weld | |
| +.045% $Ca(OH)_2$ | 62 | 6.7 | 6.9 | 6.05 | 6.05 | Weld | |
| +.100% $Ca(OH)_2$ | 45 | — | — | — | — | — | — |
| 1% B[2] in $H_2O$ | | | | | | | |
| +.020% $Ca(OH)_2$ | 38 | 6.5 | 5.9 | Weld | | | |
| +.040% $Ca(OH)_2$ | 48 | 6.5 | 6.5 | 5.7 | Weld | | |

[1]"A" is 85/15 dimethyl tetradecanephosphonate and ethoxylated rosin fatty acids.
[2]"B" is 85/15 dimethyl tetradecane phosphonate and ethoxylated dimer acids.

TABLE II

FOUR BALL WEAR TEST RESULTS WITH HYDROXIDE
½HR., 1800 RPM, 130° F.

| LUBRICANT | AWN | | Friction Coefficients | | | | | |
|---|---|---|---|---|---|---|---|---|
| | | | 7.5 kg | | | 28 kg | | |
| 1% A[1] in $H_2O$ | 7.5 kg | 28 kg | Mean | Max.* | Static | Mean | Max.* | Static |
| No $Ca(OH)_2$ | 6.45 | 7.1 | .11 | — | .12 | .092 | .096 | .092 |
| +.0075% $Ca(OH)_2$ | 6.6 | 7.1 | .089 | .095 | .095 | .090 | — | .090 |
| +.015% $Ca(OH)_2$ | 6.8 | 7.4 | .076 | .087 | .092 | .0975 | — | .10 |
| +.030% $Ca(OH)_2$ | 7.9 | 7.9 | .071 | — | .080 | .082 | — | .099 |
| | 6.5 | 7.3 | .076 | .087 | .092 | .084 | — | .084 |
| | 7.4 | 7.6 | .081 | — | .091 | .081 | .083 | .091 |
| +.045% $Ca(OH)_2$ | 7.4 | 7.1 | .095 | — | .095 | .064 | .078 | .064 |
| +.100% $Ca(OH)_2$ | 8.0 | 7.0 | .068 | — | .078 | .076 | .15 | .084 |
| 1% B[2] in $H_2O$ | | | | | | | | |
| +.020% $Ca(OH)_2$ | 7.3 | 7.5 | .073 | — | .078 | .088 | .089 | .095 |

TABLE II-continued

FOUR BALL WEAR TEST RESULTS WITH HYDROXIDE
½HR., 1800 RPM, 130° F.

| LUBRICANT | AWN | | Friction Coefficients 7.5 kg | | | 28 kg | | |
|---|---|---|---|---|---|---|---|---|
| 1% A[1] in $H_2O$ | 7.5 kg | 28 kg | Mean | Max.* | Static | Mean | Max.* | Static |
| +.040% $Ca(OH)_2$ | 7.7 | 7.4 | .091 | — | .091 | .090 | .093 | .093 |

[1]"A" is 85/15 dimethyl tetradecanephosphonate and the reaction product of rosin fatty acid with 15 moles of ethylene oxide.
[2]"B" is 85/15 dimethyl tetradecane phosphonate and ethoxylated dimer acids.
*indicates absence of a clear maximum in the friction vs. time record.

TABLE III

FOUR BALL LOAD WEAR INDEX TEST RESULTS WITH DYES AND COMPARISON WITH HYDRAULIC Oils

| Lubricant | LWI | AWN Load, Kg 50 | 63 | 79 | 100 | 126 | 158 | 200 | 250 |
|---|---|---|---|---|---|---|---|---|---|
| 1% C[3] in $H_2O$ | 62 | — | — | 6.5 | 6.3 | 6.7 | 6.4 | Weld | |
| +.01% phenolphthalein | 62 | — | — | 6.7 | 6.2 | 6.2 | 6.3 | Weld | |
| +.01% thymol blue | 49 | — | — | 6.5 | 6.3 | 6.3 | Weld | | |
| +.01% methyl orange | 39 | — | — | 7.3 | >7.4 | Weld | | | |
| +.01% p-naphtholbenzein | 49 | — | — | 6.5 | 6.3 | 6.1 | Weld | | |
| +.01% alkaline blue 6B | 49 | — | — | 7.3 | 6.35 | 6.2 | Weld | | |
| 1% A in $H_2O$ | | | | | | | | | |
| +.0120 methylorange | 62 | | | | | | | | |
| +.01% p-naphtholbenzein | 49 | | | | | | | | |

Typical LWI Data for Commercial Oil-Based Antiwear Hydraulic Oils

| Oil | Nominal Viscosity SUS at 100° F. | LWI |
|---|---|---|
| A | 150 | 31 |
| B | 215 | 30 |
| C | 315 | 37 |
| D | 700 | 35 |
| E | 1000 | 37 |

[3]"C" consists of 0.03% $Ca(OH)_2$ and 1.0% of a mixture of 85/15 dimethyltetradecanephosphonate and ethoxylated rosin fatty acid.

TABLE IV

FOUR BALL WEAR TEST RESULTS
WITH DYES AND COMPARISON WITH HYDRAULIC OILS
½Hr., 1800 RPM, 130° F.

| Lubricant | AWN 7.5 kg | AWN 28 kg | Friction Coefficients 7.5 kg Mean | Max.* | Static | 28 kg Mean | Max.* | Static |
|---|---|---|---|---|---|---|---|---|
| 1% C in $H_2O$ | 7.4 | 7.6 | .081 | — | .091 | .081 | .083 | .091 |
| +.01% phenothalein | 7.9 | 7.6 | .053 | — | .061 | .080 | .081 | .095 |
| +.01% thymol blue | 7.9 | 7.4 | .062 | — | .071 | .067 | .074 | .073 |
| +.01% methyl orange | 8.0 | 8.0 | .055 | — | .063 | .064 | .069 | .084 |
| +.01% p-naphtholbenzein | 8.0 | 8.1 | .061 | — | .074 | .062 | .066 | .081 |
| +0.1% alkaline blue | 7.8 | 7.8 | .079 | — | .090 | .080 | — | .097 |
| 1% A in $H_2O$ | | | | | | | | |
| +.0120 methyl orange | 6.7 | 6.9 | 13[a] | — | .13 | .095 | — | .095 |
| +.01% p-naphtholbenzein | 6.8 | .13[b] | — | .13 | .10[a] | — | .10 | |
| 6.6 | | | | | | | | |

Typical Wear Results for Commercial Oil-Based Antiwear Hydraulic Oils (1 hour Tests at 40 Kg)

| Oil | Nominal Viscosity, SUS at 100° F. | AWN |
|---|---|---|
| A | 750 | 7.8 |
| B | 215 | 8.3 |
| C | 315 | 8.3 |
| D | 700 | 8.3 |
| E | 1000 | 8.7 |

*indicates absence of a clear maximum in the friction vs. time record.
[a]Smooth friction.
[b]Extremely smooth friction.

TABLE V

| Test | AntiWear Number Vanes+ Ring | Ring | Vanes | Load-Wear Index AWN at 100 kg | LWI, kg | Weld, kg |
|---|---|---|---|---|---|---|
| Vickers Pump | 5.9 | 5.6 | 8.1 | | | |
| Four Ball (Wear, ½ h, | | | | | | |

TABLE V-continued

| 130° F., 1800 rpm) | 7.5 kg | 28 kg | | | |
|---|---|---|---|---|---|
| Unused Sample | 6.5 | 7.3 | 6.3 | 49 | 160 |
| Unused Sample | 6.4 | 7.1 | 6.1 | 49 | 160 |
| After Vickers Test | 6.5 | 6.9 | 6.1 | 39 | 126 |
| After Rust Test | 6.5 | 7.2 | 6.3 | 39 | 126 |
| D665 Rust Test | 10% Brown Rust, 80% Black Stain | | | | |
| D892 Seq. I Foam Test | Upper Foam Level | | 590 | | |
| | Lower Foam Level | | 180 | | |
| | Foam Level | | 410 | | |
| | Foam Collapse, Vol. at 15 min. | | 390 | | |
| Freezing Point | 1.5° C. (34.7° F.) | | | | |
| pH | 8.5 | | | | |
| Viscosity at 100° F. After Vickers Test | 0.70 cs | | | | |

Table I shows that calcium hydroxide tends to enhance load carrying of two blends of a phosphonate and ethoxylate. Table II shows synergistic improvements of these blends to calcium hydroxide in both antiwear and antifriction action. Antiwear improvement with increasing calcium hydroxide occurs at 7.5 kg and an optimum occurs at 28 kg. Reduction of friction by calcium hydroxide is evident at both loads.

Table III shows that the load carrying of phosphonate/ethoxylate blends with or without calcium hydroxide is superior to commercial anti-wear hydraulic fluids based on mineral oil. After addition of dyes, the load carrying capacity of these blends remain superior to the hydraulic oils. Table IV shows that the dyes enhance the antiwear and antifriction performance of the blends. Three of the dyes in one blend provide antiwear performance at least equivalent to that of the lowest viscosity antiwear hydraulic oil.

In a functional test of the invention a vane pump test was carried out on a Vickers V104C Pump using as the lubricant a 1% water solution of 85/15 ratio dimethyl tetradecanephosphonate and the reaction product of 1 mole of rosin fatty acid and 15 moles of ethylene oxide and 0.03% of $Ca(OH)_2$. The pump test was run at 100 F. inlet temperature, 1200 rpm, and 750 psi output pressure.

The pump was running smoothly with a constant good flow rate of about 5 gallons per minute, at the conclusion of the 100-hour test. Weight loss of the cam ring due to wear was 3400 mg at the end of the test, while that of the vanes was 12 mg. These results are expressed as AntiWear Number (AWN) in Table V.

Completion of the Vickers test with a good constant pump flow demonstrates that lubricating by 99% water is technically feasible.

It will thus be seen that there is provided a composition in which the several objects of this invention are achieved, and which is well adapted to meet the conditions of practical use.

As various possible embodiments might be made of the above invention, and as various changes might be made in the embodiment above set forth, it is to be understood that all matter herein set forth or shown in the accompanying tables is to be interpreted as illustrative and not in a limiting sense.

Having thus described our invention we claim as new and desire to secure by Letters Patent:

1. Water-based lubricants for use in metal working processing and as hydraulic fluids comprising; in weight percent, from 0.005 to 4.0 percent of a $C_6$–$C_{18}$ alkyl phosphonate or an amine adduct thereof; from 0.005 to 4.0 percent of an ethoxylated oleic acid, ethoxylated dimer acid, or a mixture of ethoxylated rosin fatty acids, from 0.003 to 0.60 percent of an alkali or alkaline earth metal hydroxide, balance water.

2. The lubricant of claim 1, wherein said hydroxide is $Ca(OH)_2$.

3. The lubricant of claim 1 also containing a dye of the group of methyl orange, thymol blue, and p-naphthyl benzene.

4. The lubricant of claim 1 comprising an aqueous solution containing 1 percent by weight of 85/15 ratio of dimethyl tetradecanephosphonate and the reaction product of rosin fatty acid with 15 moles of ethylene oxide and 0.03 percent by weight of $Ca(OH)_2$.

* * * * *